United States Patent [19]

Boeshart

[11] Patent Number: 5,039,058

[45] Date of Patent: Aug. 13, 1991

[54] HINGED TIE FOR FORMING ANGLES WALLS

[76] Inventor: Patrick E. Boeshart, Rte. 1, Box 134, Sioux City, Iowa 51108

[21] Appl. No.: 550,625

[22] Filed: Jul. 10, 1990

[51] Int. Cl.[5] ..... E04G 17/02

[52] U.S. Cl. ..... 249/194; 16/225; 249/170; 249/219.1

[58] Field of Search ..... 249/170, 171, 185, 194, 249/210, 219.1; 52/98, 426, 562; 16/225, 252

[56] References Cited

U.S. PATENT DOCUMENTS

| | | | |
|---|---|---|---|
| 3,662,985 | 5/1972 | Parker | 249/194 |
| 4,154,362 | 5/1979 | McKenney | 16/225 |
| 4,320,888 | 3/1982 | Oury | 249/46 |
| 4,563,381 | 1/1986 | Woodland | 16/225 |
| 4,604,843 | 8/1986 | Ott et al. | 52/426 |
| 4,784,509 | 11/1988 | Gozzano | 16/225 |
| 4,860,515 | 8/1989 | Browning, Jr. | 52/426 |
| 4,888,931 | 12/1989 | Meilleur | 52/426 |
| 4,916,879 | 4/1990 | Boeshart | 52/426 |

FOREIGN PATENT DOCUMENTS

| | | | |
|---|---|---|---|
| 2439807 | 3/1976 | Fed. Rep. of Germany | 16/225 |
| 400820 | 5/1966 | Switzerland | 16/225 |

*Primary Examiner*—James C. Housel

*Attorney, Agent, or Firm*—Zarley, McKee, Thomte, Voorhees & Sease

[57] ABSTRACT

A hinged tie is designed to connect the ends of two elongated polystyrene form panels at a predetermined angular orientation. Each tie includes first and second plate members hinged along a common vertical edge to form a vertical pivotal axis. Each plate member has a strap projecting therefrom with a paddle mounted at the projecting end of the strap oriented parallel to the corresponding plate member. The straps correspond with tie slots cut in each form panel such that the form panels are retained between the paddles and plate members. The hinge permits the form panels to be retained in abutting contact at a variety of predetermined angles.

1 Claim, 1 Drawing Sheet

HINGED TIE FOR FORMING ANGLES WALLS

TECHNICAL FIELD

The present invention relates generally to ties for poured concrete wall systems, and more particularly to an improved hinged tie which will connect the adjacent end of two form panels at a variety of angles.

BACKGROUND OF THE INVENTION

While wall forming systems have been in use for many years, a recent development in this industry is in the use of polystyrene panels as forms for the poured concrete walls. After the concrete has hardened, the panels may be left in place on the walls to serve as permanent insulation, or may be stripped off the walls to reveal the exposed concrete.

Upon introduction of this new wall forming system, it was found that it was unnecessary to use small "building blocks" to create the form panels to build a form system for receiving poured concrete. Rather, larger and larger panels are now being utilized to create the concrete forms. As the panels grow in size, the applicant herein devised a new type of tie, described in U.S. Pat. No. 4,765,109, which had special ends that could be "knocked off" to easily remove the large panels from the walls. While the patented tie has proved successful for its intended purpose, it was always necessary to utilize a special additional framing system to hold the frame systems at the intersection of two walls, or at a corner where two walls meet.

Right angle corners and T intersections were provided with a special corner tie devised by applicant herein, described in U.S. Pat. No. 4,916,879. However, the corner tie is not designed for use in forming angled walls of a variety of obtuse angles.

It is therefore a general object of the present invention to provide a special hinged tie for use with polystyrene panel type forms on poured concrete walls.

Another object is to provide a hinged tie which will hold the ends of a pair of abutting form panels to form a rigid angled corner for a poured concrete wall.

A further object of the present invention is to provide a hinged tie which will rigidly connect the ends of a pair of form panels at a variety of angles.

Still another object is to provide a hinged tie which permits quick and easy construction of concrete form panels to form an angled corner.

These and other object of the present invention will be apparent to those skilled in the art.

SUMMARY OF THE INVENTION

The hinged tie of the present invention is designed to connect the ends of two elongated polystyrene form panels at a predetermined angular orientation. Each tie includes first and second plate members hinged along a common vertical edge to form a vertical pivotal axis. Each plate member has a strap projecting therefrom with a paddle mounted at the projecting end of the strap oriented parallel to the corresponding plate member. The straps correspond with tie slots cut in each form panel such that the form panels are retained between the paddles and plate members. The hinge permits the form panels to be retained in abutting contact at a variety of predetermined angles.

DESCRIPTION OF THE PREFERRED EMBODIMENT

Figure 1:
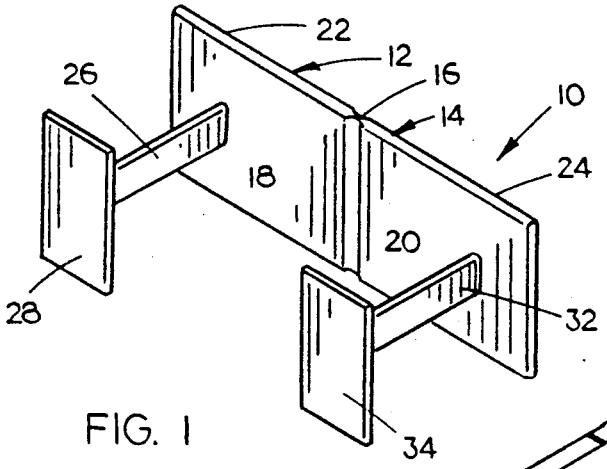
FIG. 1 is a perspective view of the hinged tie of the present invention.

Referring now to the drawings, in which identical or corresponding parts are identified with the same reference numeral, and more particularly to FIG. 1, the tie of the present invention is designated generally at 10 and is preferably formed of a synthetic material.

Tie 10 includes a pair of elongated plates 12 and 14 connected along a common vertical edge to form a hinge 16. Plates 12 and 14 include front surfaces 18 and 20, respectively, and back surfaces 22 and 24, respectively. Preferably, plates 12 and 14 are formed from a single strap of material with a living hinge 16, such that plates 12 and 14 are a single integral unit.

Figure 2:
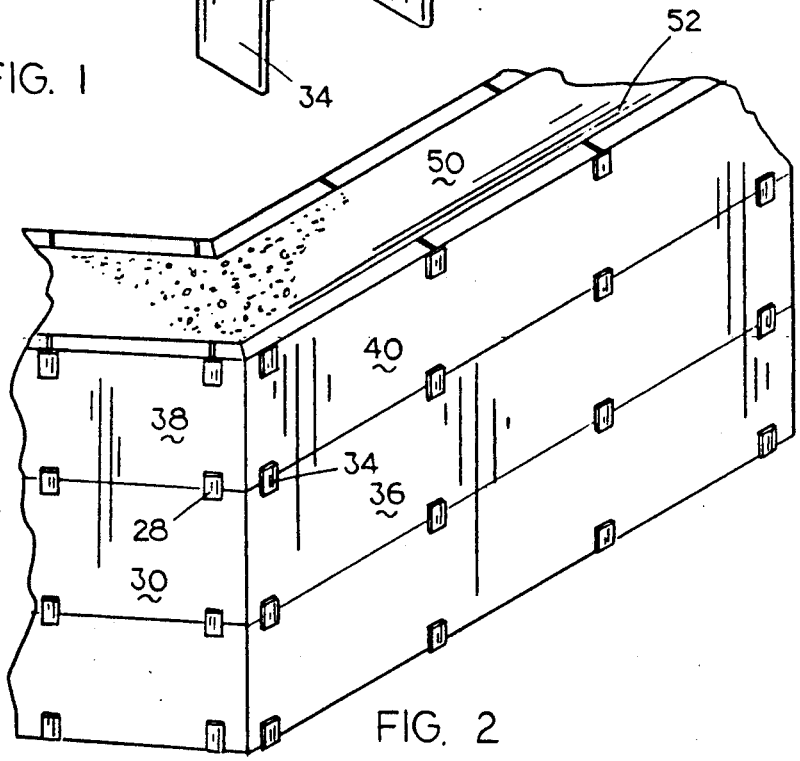
FIG. 2 is a perspective view of a series of form panels connected by a series of ties of the present invention to form an angled corner.
Figure 3:
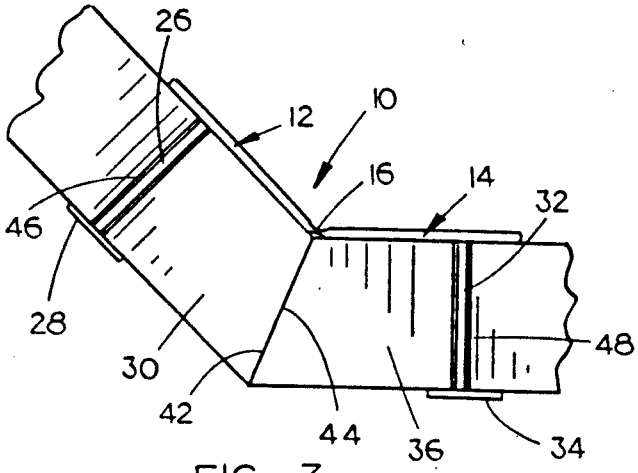
FIG. 3 is a top view of a tie installed between a pair of form panels.

A first strap 26 projects perpendicularly from front surface 18 of plate 12, and has a paddle member 28 connected to the outer end thereof. Paddle member 28 is preferably parallel to plate member 12, and positioned a distance from plate member 12 to retain a concrete form panel 30 (as shown in FIG. 3) therebetween. A similar strap 32 projects perpendicularly from front surface 20 of plate 14 and has a paddle member 34 affixed to the free end thereof parallel to plate 14. Paddle member 34 is spaced a distance from plate 14 to receive a form panel 36 (as shown in FIG. 3) therebetween. Straps 26 and 32 are preferably formed with a rectangular cross section having a vertical longitudinal axis. This permits the upper half of the straps 26 and 32 to contact an upper pair of panels, and the lower half of straps 26 and 32 to contact a lower pair of panels when tie 10 is mounted between a pair of lower abutting panels 30 and 36 and a pair of upper abutting panels 38 and 40 (as shown in FIG. 2).

In order to form an angled wall, the ends 42 and 44 of a pair of form panels 30 and 36 are beveled at the desired angle, and a pair of slots 46 and 48 are cut in the upper edge to receive straps 26 and 32 respectively. Tie 10 is then bent at hinge 16 to the appropriate angle and straps 26 and 32 are inserted within slots 46 and 48 so as to retain form panels 30 and 36.

Figure 4:
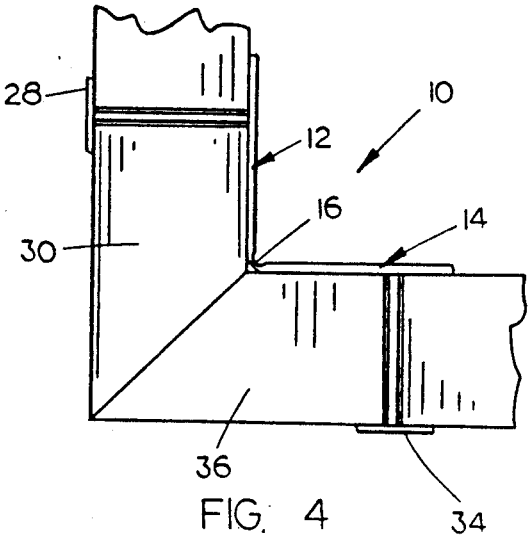
FIG. 4 is a top view of a tie installed between a pair of form panels connected at a different angle than that of FIG. 3.

FIG. 4 shows that tie 10 may be bent to a variety of angles so as to connect a pair of form panels 30 and 36 at a wide variety of angles.

If the height of the wall will be in excess of the height of one form panel 30 or 36, slots 46 and 48 are cut to a depth approximately one half the height of plates 12 and 14, so that the upper half of straps 26 and 32, as well as the upper halves of paddles 28 and 34 and plates 12 and 14 project upwardly out of form panels 30 and 36. Similar slots are then cut in the bottom edge of upper form panels 38 and 40 to joint the panels at the desired angle. Once concrete 50 has been poured between the form panels, and allowed to harden, the form panels along the outer surface of the wall 52 by "knocking off" the end paddles 54 of the conventional ties, and the outer paddles 28 and 34 of the hinged ties. The hinged ties are preferably formed of a synthetic polyester material such that a sharp vertical blow to the outer paddles 28 and 34 will cause straps 26 and 32 to break, permitting the removal of form panels 30 and 36.

Whereas the invention has been shown and described in connection with the preferred embodiment thereof, it will be understood that many modifications, substitutions and additions may be made which are within the intended broad scope of the appended claims. There has therefore been shown and described an improved hinged tie which accomplishes at least all of the above stated objects.

I claim:

1. In combination:

a first form panel having first and second vertical ends, upper and lower edges and front and back surfaces;

a second form panel having first and second vertical ends, upper and lower edges and front and back surfaces;

at least a first tie slot formed in the upper edge of said first form panel and extending between the front and back surfaces adjacent said first end thereof, for receiving a portion of a tie;

at least one tie slot formed int he upper edge of said second form panel and extending between the front and back surfaces adjacent the first vertical end thereof for receiving a portion of a tie therein;

said first end of said first form panel and said first end of said second form panel having a beveled edge formed thereon such that said first edge of said first and second form panels will abut in flush contact in a predetermined angular relationship;

a hinge tie for retaining said first and second form panels in predetermined angular relationship;

said hinged tie comprising:

first and second plate members having front and back surfaces and at least one generally vertical edge;

hinged means connecting said at least one vertical edge of said first and second plate members to form a generally vertical axis;

said first plate member having means projecting from said front surface for receipt in said first tie slot, for connecting said first plate member to said first form panel;

said second plate member having means projecting from its front surface for receipt in said second form panel tie slot, for connecting said second plate member to said second form panel.

* * * * *